US007356268B2

(12) United States Patent
Itoyama

(10) Patent No.: US 7,356,268 B2
(45) Date of Patent: Apr. 8, 2008

(54) DEVELOPING DEVICE

(75) Inventor: Motoyuki Itoyama, Souraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 189 days.

(21) Appl. No.: 11/326,371

(22) Filed: Jan. 6, 2006

(65) Prior Publication Data

US 2006/0177235 A1 Aug. 10, 2006

(30) Foreign Application Priority Data

Feb. 10, 2005 (JP) ..... 2005-034171

(51) Int. Cl.
*G03G 15/08* (2006.01)
*G03G 15/00* (2006.01)

(52) U.S. Cl. ..... 399/30; 399/63; 399/258

(58) Field of Classification Search ..... 399/58, 399/63, 62, 64, 30, 258, 260; 347/19; 358/406, 358/504

See application file for complete search history.

(56) References Cited

U.S. PATENT DOCUMENTS 5,027,157 A * 6/1991 Hotomi et al. ..... 399/253
5,036,363 A * 7/1991 Iida et al. ..... 399/30
5,038,175 A * 8/1991 Sohmiya et al. ..... 399/58
5,055,881 A * 10/1991 Fukuchi ..... 399/13
5,081,498 A * 1/1992 Bares ..... 399/58
5,311,261 A * 5/1994 Nakagama et al. ..... 399/63
5,438,393 A * 8/1995 Komatsu et al. ..... 399/30 X
2004/0151514 A1* 8/2004 Shuji ..... 399/258 X
2005/0214047 A1* 9/2005 Tohata ..... 399/359
2006/0008281 A1* 1/2006 Matsumoto et al. ..... 399/27

FOREIGN PATENT DOCUMENTS

JP 63-284581 A 11/1988
JP 4-19765 A 1/1992
JP 06-083197 A * 3/1994
JP 10-78696 A 3/1998
JP 2004-287388 A 10/2004
JP 2005-148368 A 6/2005

* cited by examiner

*Primary Examiner*—Sophia S. Chen
(74) *Attorney, Agent, or Firm*—Nixon & Vanderhye P.C.

(57) ABSTRACT

A controller determines the degree of acuteness of the resonant oscillation of a piezoelectric oscillator, based on the developer's fluidity detection data detected by the piezoelectric oscillator. The toner density output data detected by a toner density sensor is modified to a correct value, based on the degree of acuteness, and a supply roller is controlled based on this corrected value so as to implement the necessary toner supply.

8 Claims, 11 Drawing Sheets

$V = 3.0 - 0.5 \cdot \exp(-t/\tau_d)$ 3.0: Sensor output when the developer is not electrified
−0.5: Reduction in output due to electrification
$\tau_d$ : Discharge time constant ($\fallingdotseq 1.44 \times 10^3$ sec 4hr)

$V = 3.0 - 0.5 \cdot \{1 - \exp(-t/\tau_d)\}$ 3.0 : Sensor output when the developer is not electrified
−0.5 : Reduction in output due to electrification
$\tau_d$ : Discharge time constant (≒300sec 5min)

FIG. 10

Correction based on the degree of acuteness Q

| | T/D | Fr | F1 | F2 | Q | |
|---|---|---|---|---|---|---|
| REF | 5% | 503 | 398 | 637 | 2.10 | (a) |
| | 4% | 459 | 370 | 570 | 2.30 | (a) |
| | Correction Coef. | 1.10 | | | | (c)=(b)/(a) |
| | Corrected T/D | 4.0% | | | | (d)=4%/(c)+0.3% |

F1, F2: Frequencies at which the admittance (current) is equal to 0.707 times
Q=Fr/(F2−F1)

FIG. 11

Simplified correction

| T/D | Fr | F0.5 | Fr/F0.5 | |
|---|---|---|---|---|
| 5% | 503 | 337 | 1.49 | (e) |
| 4% | 459 | 318 | 1.44 | (f) |
| Correction Coef. | 0.97 | | | (g)=(f)/(e) |
| Corrected T/D | 4.1% | | | (h)=4%/((1−(g))＊2+1)+0.3% |

T/D: Magnetic permeability sensor output
F0.5: Frequency at which the admittance (current) is equal to 0.5 times

FIG. 12

An example where the fluidity and volume density have varied

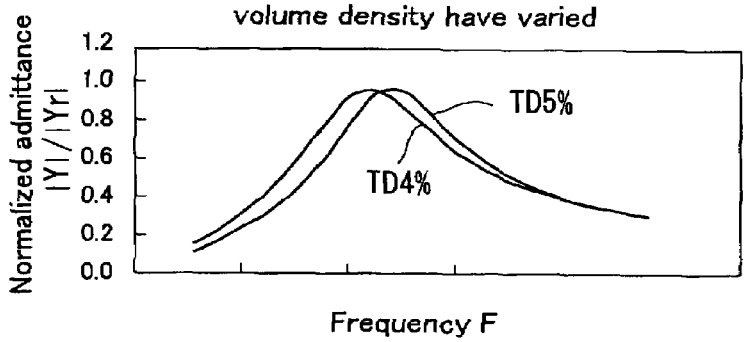

FIG. 13

Correction based on the degree of acuteness Q

| | T/D | Fr | F1 | F2 | Q | |
|---|---|---|---|---|---|---|
| REF | 5% | 503 | 398 | 637 | 2.10 | (a) |
| | 4% | 459 | 348 | 607 | 1.77 | (b) |
| | Correction Coef. | 0.84 | | | | (c)=(a)/(b) |
| | Corrected T/D | 5.0% | | | | (d)=4%/(c)+0.3% |

F1, F2: Frequencies at which the admittance (current) is equal to 0.707 times
Q=Fr/(F2−F1)

FIG. 14

Simplified correction

| T/D | Fr | F0.5 | Fr/F0.5 | |
|---|---|---|---|---|
| 5% | 503 | 337 | 1.49 | (e) |
| 4% | 459 | 287 | 1.60 | (f) |
| Correction Coef. | 1.07 | | | (g)=(f)/(e) |
| Corrected T/D | 5.0% | | | (h)=4%/((1−(g))*2+1)+0.3% |

T/D: Magnetic permeability sensor output
F0.5: Frequency at which the admittance (current) is equal to 0.5 times Correction based on the degree of acuteness Q

| | T/D | Fr | F1 | F2 | Q | |
|---|---|---|---|---|---|---|
| REF | 5% | 503 | 398 | 637 | 2.10 | (a) |
| | 4% | 563 | 468 | 677 | 2.69 | (b) |
| | Correction Coef. | 1.28 | | | | (c)=(a)/(b) |
| | Corrected T/D | 5.0% | | | | (d)=6%/(c)+0.3% |

F1, F2: Frequencies at which the admittance (current) is equal to 0.707 times

Q=Fr/(F2−F1)

FIG. 17
Simplified correction
| T/D | Fr | F0.5 | Fr/F0.5 | |
|---|---|---|---|---|
| 5% | 503 | 337 | 1.49 | (e) |
| 6% | 563 | 410 | 1.37 | (f) |
| Correction Coef. | 0.92 | | | (g)=(f)/(e) |
| Corrected T/D | 5.5% | | | (h)=6%/((1−(g)) * 2+1)+0.3% |
T/D: Magnetic permeability sensor output
F0.5: Frequency at which the admittance (current) is equal to 0.5 times
FIG. 18
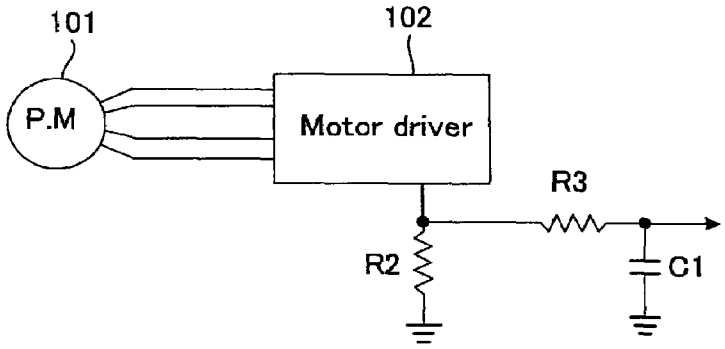
FIG. 19
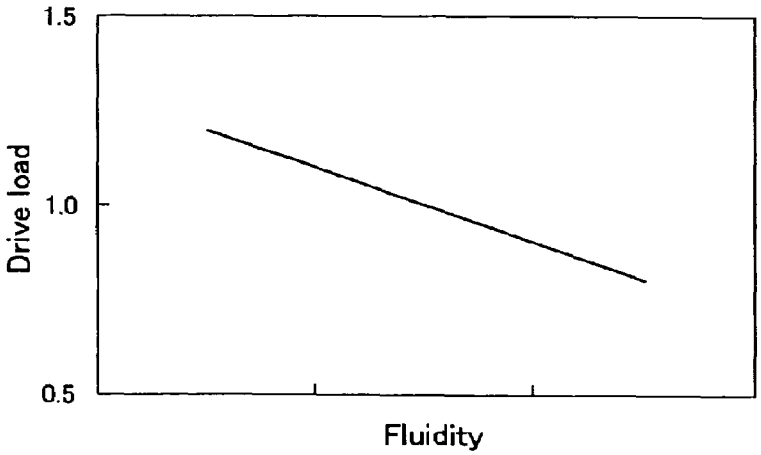

| | High fluidity | Standard | Low fluidity | |
|---|---|---|---|---|
| Sensor output | 4% | 5% | 6% | (a) |
| Drive load | 1.2 | 1 | 0.8 | (b) |
| After correction | 4.8% | 5.0% | 4.8% | (a) * (b) |

| | Magnetic permeability sensor output | | |
|---|---|---|---|
| Toner density | High fluidity | standard | Low fluidity |
| 3% | 2. 5% | 3. 0% | 3. 6% |
| 4% | 3. 3% | 4. 0% | 4. 8% |
| 5% | 4. 2% | 5. 0% | 6. 0% |
| 6% | 5. 0% | 6. 0% | 7. 2% |

DEVELOPING DEVICE

This Nonprovisional application claims priority under 35 U.S.C. §119 (a) on Patent Application No. 2005-34171 filed in Japan on 10 Feb. 2005, the entire contents of which are hereby incorporated by reference.

BACKGROUND OF THE INVENTION (1) Field of the Invention

The present invention relates to a developing device for use in a copier or laser printer, for implementing toner supply based on the output data from a toner density sensor so as to keep the density of the toner in a dual-component developer in the developing device constant.

(2) Description of the Prior Art

The image forming apparatus such as a copier, laser printer or the like includes a developing unit arranged near the photoreceptor so as to form a toner image by development with the toner adhering from the developing unit to the electrostatic latent image on the photoreceptor. There are two types of developers to be used for development, namely mono-component type and dual-component type. A mono-component type developer consists of the toner only, so there is no need to control the toner density when the developer is supplied to the developing unit. On the contrary, a dual-component type consists of a toner and a magnetic carrier which electrifies the toner while conveying the toner to the development region where only the toner is consumed for development and the carrier is left in the developing unit. Accordingly, the mixture ratio between the toner and the carrier in the developer varies, so that it is necessary to keep the toner density constant by supplying the toner so as to maintain the quality of image forming.

In a conventional image forming apparatus, a magnetic permeability sensor (toner density sensor) has been used to detect the varying magnetic permeability of the developer with change of the amount of the carrier so as to determine the toner density and thereby control toner supply. Specifically, if the sensor outputs a higher value than the reference level, the toner is added because increase in magnetic permeability is understood to be caused by an increased mixture proportion of the carrier. If the sensor output lowers compared the reference level, toner supply is stopped because decrease in magnetic permeability is understood to be caused by a lower mixture proportion of the carrier.

However, there has been a problem with the toner density sensor that the sensor cannot detect the correct value because the measurement may fluctuate due to humidity and/or the agitated condition of the toner. With regard to humidity, for example, the sensor output is low with a lower humidity while the sensor output is high with a higher humidity for different toner density levels, as shown in FIG. 1. Accordingly, a developer having a toner density of 4% is measured for different humidity conditions, the sensor output increases as the humidity becomes higher as shown in FIG. 2.

This phenomenon can be explained as follows. Under a lower humidity environment, the developer is reduced in moisture content and increased in the amount of electric charge thereon. As a result, repulsion between developer particles becomes stronger so that the developer's volume density decreases, causing the sensor output to be lower. In contrast, under a high humidity environment, the developer is increased in moisture content and reduced in the amount of electric charge thereon. As a result, repulsion between developer particles becomes weaker so that the developer's volume density increases, causing the sensor output to be higher.

Also, as shown in FIG. 3, when the developer has been left unused for a long time, the amount of charge thereon lowers due to discharge, hence repulsion between developer particles becomes weaker so that the developer's volume density increases, causing the sensor output to be higher. When the developer is agitated in the developing unit, the electric charge on the developer increases. As a result, repulsion between developer particles becomes stronger so that the developer's volume density decreases, causing the sensor output to be lower as shown in FIG. 4.

In the above ways, as the developer's volume density decreases with increase in electric charge thereon, the magnetic permeability sensor erroneously detects that the toner density is high. On the other hand, as the developer's volume density increases with reduction in electric charge thereon, the magnetic permeability sensor erroneously detects that the toner density is low.

To deal with this, Japanese Patent Application Laid-open Sho 63 No. 284581 (Patent literature 1) discloses a configuration in which, when due to some variation of the fluidity of the developer, toner oversupply occurs causing foggy images or insufficient toner supply occurs causing lowered image density, the sensor output is manually controlled in accordance with the fluidity so as to shift the toner density output characteristics, thereby providing good images.

Japanese Patent Application Laid-open Hei 4 No. 19765 (Patent literature 2) discloses another configuration in which the output of the magnetic permeability sensor is attempted to be modified by measuring the time that is taken for the supplied toner to travel one circulation of the toner conveyance path formed of two screws with the permeability sensor, determining the fluidity based on the time for circulation, and estimating the volume density from that fluidity.

In the technology of Patent literature 1, however, the shifting means of the sensor output is actuated only when the user notices the occurrence of oversupply or insufficient supply of toner. That is, this configuration is not a one that detects the cause of image degradation and controls the toner density before the occurrence of image degradation.

In the technology of Patent literature 2, though the output from the magnetic permeability sensor is corrected based on the fluidity that is automatically detected, this configuration takes too a long measurement time and hence cannot make real-time correction because the sensor output needs to be corrected by measuring the time that is taken for the toner to travel one circulation of the toner conveyance path by the permeability sensor, determining the fluidity based on that time for the toner making one circulation and estimating the volume density from that fluidity.

SUMMARY OF THE INVENTION

It is therefore an object of the present invention to provide a toner density control device for an image forming apparatus in which the detected magnetic permeability can be corrected in real time based on the developer's fluidity so that the image quality can be improved by keeping the toner density constant.

In accordance with the present invention, a developing device for developing an electrostatic latent image formed on a photoreceptor with a dual-component developer, made up of a toner and a carrier while the developer being agitated by an agitating member, includes: a toner supply section for supplying the toner; a toner density detector for detecting the toner density of the developer based on magnetic permeability; and a fluidity detector for detecting the fluidity of the developer, and is characterized in that the output from the toner density detector is corrected based on the detected data from the fluidity detector, and toner supply from the toner supply section is performed based on the corrected output so as to keep the toner density constant.

The fluidity detector is a piezoelectric oscillator, and detects fluidity based on the degree of acuteness of the resonant oscillation of the piezoelectric oscillator. Here, the piezoelectric oscillator is a unimorph oscillator or bimorph oscillator.

The invention is also characterized in that the fluidity detector detects fluidity based on the variation of the load torque on the agitating member. In this case, the fluidity detector may detect the variation of the load torque based on change in the rotational rate of the agitating member, may detect the variation of the load torque based on change in the current through a motor for driving the agitating member, or may detect the variation of the load torque based on change in the output from the toner density sensor while the developer passes through the agitating member.

According to the present invention, the output from the toner density sensor along with the change of the volume density is corrected so as to prevent erroneous detection of toner density along with variation in the volume density of the developer, hence it is possible to maintain high image quality.

Since the fluidity detector uses a piezoelectric oscillator, it is possible to detect fluidity with high precision. Further, since the detected value of toner density is corrected based on the degree of acuteness of the resonation frequency, it is possible to perform detection with a relatively simple circuit without the necessity of complicated circuitry for maintaining accuracy. Since a unimorph oscillator or bimorph oscillator is used as the piezoelectric oscillator, the oscillator can be configured so as to be operated in a flexural mode. Accordingly, it is possible to make the variation of the vibrated state caused by the developer distinctive by reducing the rigidity of the oscillator compared to those using other modes such as length vibration, expansion vibration, shear vibration and other modes. As a result it is possible to enhance the sensor sensitivity and improve the S/N ratio.

Further, the output from the magnetic permeability sensor is modified by detecting the fluidity based on the variation in the load torque on the agitating member. That is, the developer's fluidity can be detected directly, so it is possible to improve modification accuracy.

Since the fluidity is detected based on the variation in the output of the magnetic permeability sensor along with the passage of the developer caused by the agitating element (this is the distinct feature from the prior art disclosures), the magnetic permeability sensor can be used for both toner density detection and fluidity detection, thus making it possible to simplify the apparatus configuration.

BRIEF DESCRIPTION OF THE DRAWINGS

FIG. 10 is a chart for explaining correction to the output value of a toner density sensor based on the degree of acuteness Q in the above case;

FIG. 11 is a chart for explaining correction to the output value of a toner density sensor based on Fr/F0.5;

FIG. 12 is a graph showing the relationships between the frequency and the normalized admittance when the fluidity and volume density have varied;

FIG. 13 is a chart for explaining correction to the output value of a toner density sensor based on the above degree of acuteness Q in the above case;

FIG. 14 is a chart for explaining correction to the output value of a toner density sensor based on Fr/F0.5;

FIG. 17 is a chart for explaining correction to the output value of a toner density sensor based on Fr/F0.5;

FIG. 18 is a circuit diagram illustrating detection of motor current by a fluidity detection sensor;

FIG. 19 is a graph showing the relationship between drive load torque and fluidity;

DESCRIPTION OF THE PREFERRED EMBODIMENTS

The embodiment of the present invention will hereinafter be described with reference to the accompanying drawings.

Figure 1:
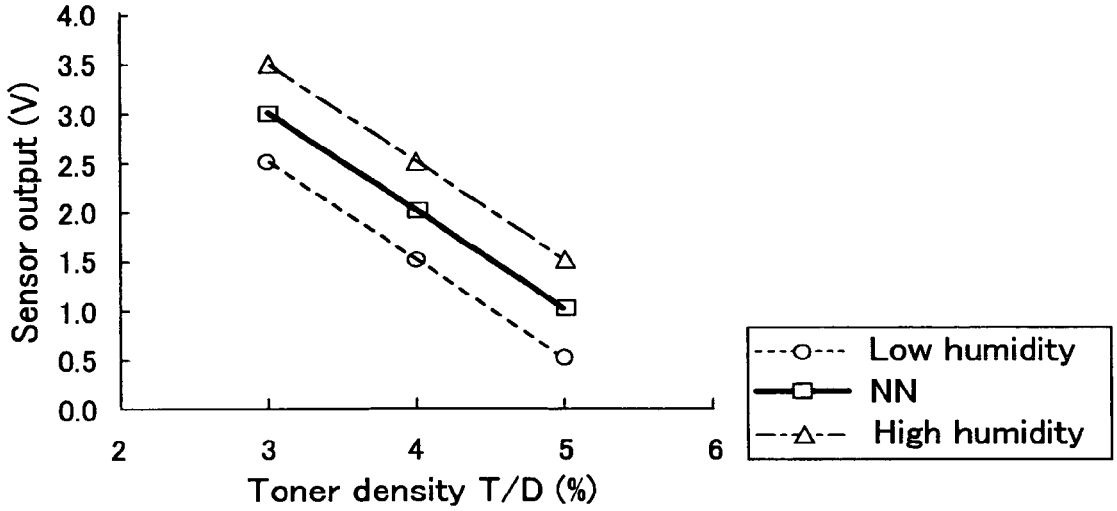
FIG. 1 PRIOR ART
FIG. 1 is a graph showing the relationships between toner density and sensor output under different humidity conditions.
Figure 2:
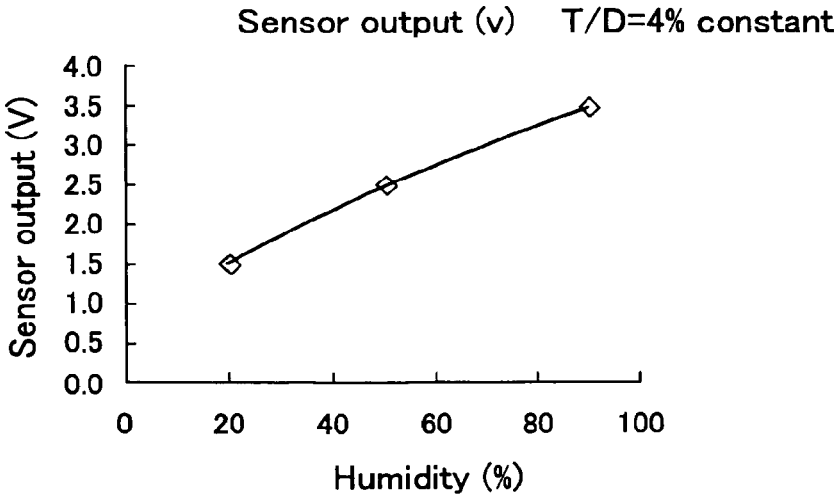
FIG. 2 PRIOR ART
FIG. 2 is a graph showing the relationship between the humidity of the developer and the sensor output when the toner density is 4%.
Figure 3:
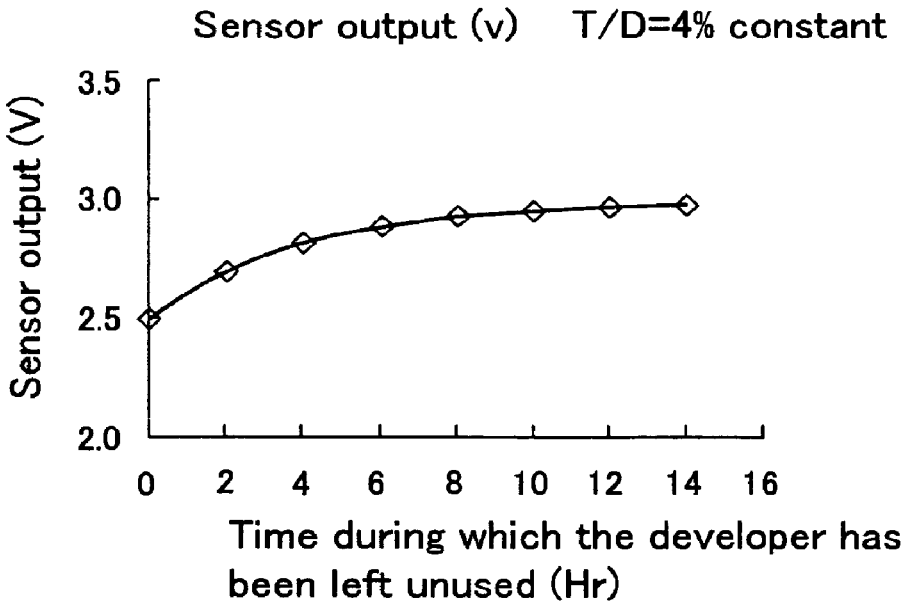
FIG. 3 PRIOR ART
FIG. 3 is a graph showing the relationship between the time during which the developer has been left unused and the sensor output.
Figure 4:
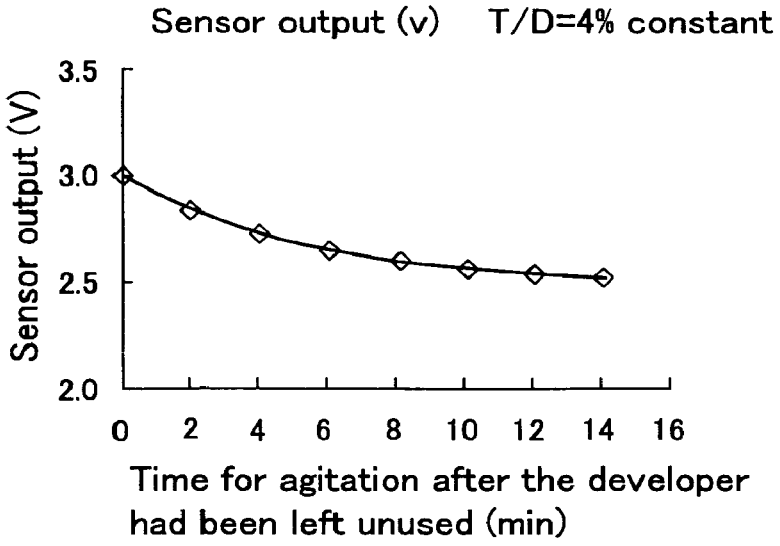
FIG. 4 PRIOR ART
FIG. 4 is a graph showing the relationship between the time of agitation after the developer had been left unused and the sensor output.
Figure 5:
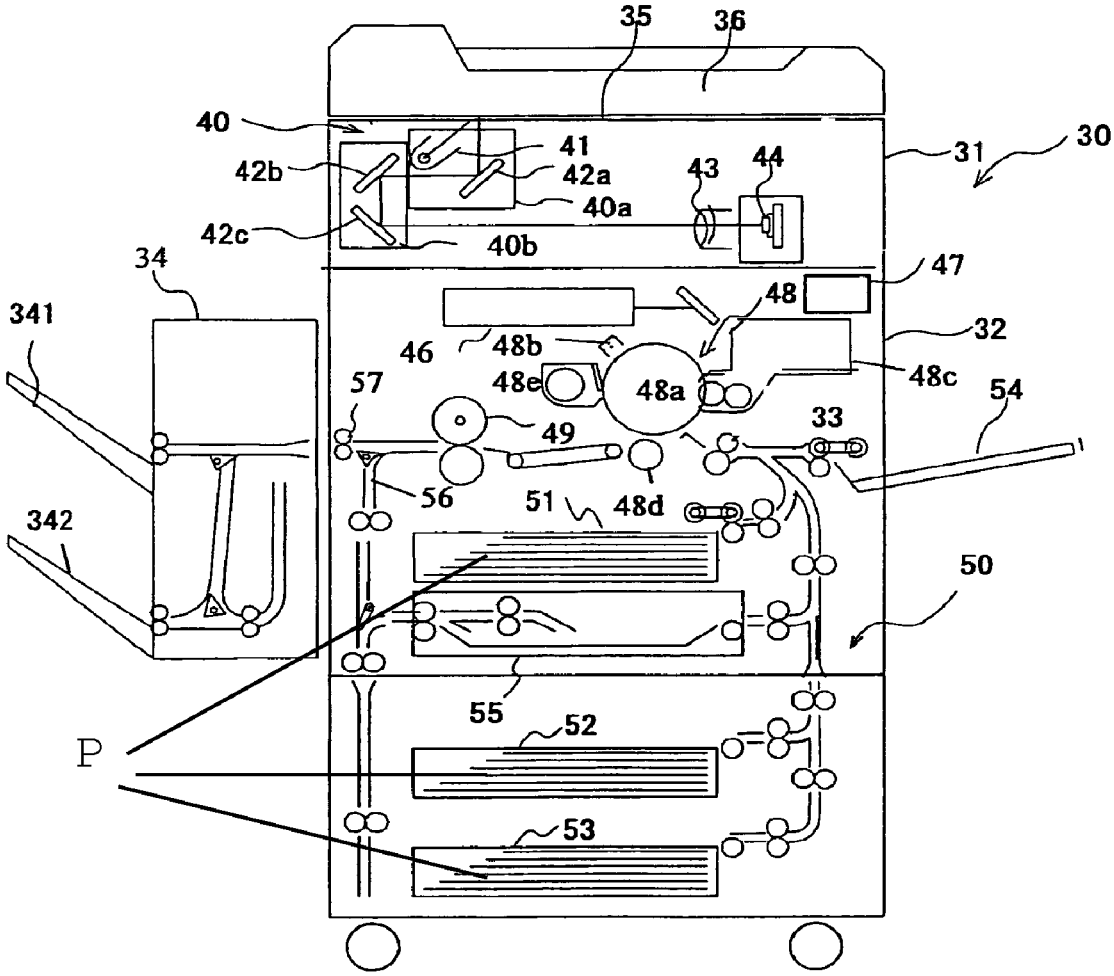
FIG. 5 is a schematic view showing an image forming apparatus having a developing device according to the present invention.

FIG. 5 is a schematic diagram showing an image forming apparatus having a developing device according to the present invention. The image forming apparatus of the embodiment is a digital copier 30, which is mainly composed of a scanner portion 31 and a laser printer portion (laser recording portion) 32. This will be described in detail hereinbelow.

Scanner portion 31 includes: an original table 35 of transparent glass on which a fixed document is placed; a reversing automatic document feeder (RADF) 36 for conveying and feeding originals automatically onto original table 35; and an original image reading unit, i.e., scanner unit 40 for reading the image of the original placed on original table 35 by scanning it.

The original image captured by this scanner portion 31 is sent in an image data form to an aftermentioned image processor 47, where the image data is subjected to predetermined image processes.

The RADF 36 is a device which has a number of documents placed at a time on a document tray at the top thereof so that the set documents are automatically fed one by one onto original table 35 of scanner unit 40. In order for scanner unit 40 to read one side or both sides of originals in accordance with the operator choice, RADF 36 is comprised of a one-sided document feed path, a dual-sided document feed path, a feed path switching device, a group of sensors for detecting and managing the state of the document passing through various positions, a controller and the like. Since for RADF 36 many applications and products have been proposed, no further description will be given here.

Scanner unit 40 as a part of scanner portion 31 for reading the image of the original on original table 35 includes: a lamp reflector assembly 41 for exposure of the document surface; a first scan unit 40*a* provided with a first reflection mirror 42*a* for reflecting the reflected light from the original to direct the reflected light image from the original to a photoelectric transducer 44; a second scan unit 40*b* provided with second and third reflection mirrors 42*b* and 42*c* for directing the reflected light image from first reflection mirror 42*a* toward photoelectric transducer 44; an optical lens 43 for condensing and focusing the light reflected from the original and passing through the above reflection mirrors 42*a* to 42*c* onto the photoelectric transducer 44; and electric transducer 44 made up of an arrayed CCD (charge-coupled device) for converting the reflected and focused light image from the original into electric image signals.

Scanner portion 31 is constructed so as to read the original image by moving scanner unit 40 along the undersurface of original table 35 as the originals to be read are being successively placed onto original table 35 by the cooperative actions of RADF 36 and scanner unit 40.

More illustratively, first scan unit 40*a* travels at a constant speed V from left to right along original table 35 while second scan unit 40*b* is controlled so as to travel parallel to and in the same direction as the first scan unit at a speed of V/2. By this operation, the image of the original placed on original table 35 is focused on and successively read linewise by CCD 44.

The image data captured by scanner unit 40 by reading the original image is sent to image processor 47, where the data is subjected to various processes. Then the processed image data is temporarily stored into the memory of image processor 47. The image is loaded from the memory in response to an output instruction and transferred to laser printer portion 32, whereby the image is formed on recording paper. Since various kinds of configurations can be considered to construct the image processor 47, no description will be given here.

This laser printer portion 32 includes a paper conveying system 50 for conveying sheets as recording media on which images are formed, a laser writing unit 46 and an electrophotographic processing portion 48 for forming images.

Laser writing unit 46 includes: a semiconductor laser source for emitting laser beams in accordance with the image data captured by the aforementioned scanner unit 40 and loaded from the memory or the image data transferred from another external device; a polygon mirror for deflecting the laser beam at an equiangular speed; and an f-theta lens for correcting the laser beam deflected at an equiangular speed so that the laser spot focused on the photoreceptor drum surface 48*a* of electrophotographic processing portion 48 will move at a constant speed.

The aforementioned electrophotographic processing portion 48 essentially includes: a charger 48*b*, a developing unit 48*c*, a transfer unit 48*d*, a cleaning unit 48*e*, an erasing unit (provided with the charger), all being arranged around a photoreceptor drum 48*a*.

Photoreceptor drum 48*a* is basically composed of, as its constituent layers, a conductive substrate layer formed of a conductive metal such as aluminum and a photoconductive layer formed on the outer surface, and rotated at a predetermined peripheral speed (process speed). The surface of photoreceptor drum 48*a* is electrified by charger 48*b* with a predetermined polarity at a predetermined potential. Then, the drum is exposed to light of an image so as to form an electrostatic latent image thereon, which in turn is developed by the developing unit, forming a toner image.

Illustratively, the surface of photoreceptor drum 48*a* having been uniformly charged with negative charge by means of charger 48*b* is irradiated with a laser beam from the writing unit 46 in the region (image forming region) before developing unit 48*c*. Positive electric charge is generated in the areas that have been irradiated with the laser beam, from the photoelectric effect, causing change in electric charge distribution, so that picture elements where the amount of electric charge has varied form an electrostatic latent image.

Charger 48*b* in this embodiment uses a scorotron charger having a grid electrode. A predetermined charging voltage Vg is applied to the grid element of charger 48*b* from an unillustrated voltage source so as to electrify the photoreceptor drum 48*a* surface by corona discharge.

In developing unit 48*c* of the embodiment, the toner of a dual-component developer is applied at a predetermined developing bias by the developing roller, so that the toner is attracted and adheres to photoreceptor drum 48*a* by electrostatic force, whereby the electrostatic latent image on photoreceptor drum 48*a* is developed by reversal development.

Transfer unit 48*d* is configured of a roller type, specifically, a transfer roller which presses recording paper P toward the toner image-forming area on photoreceptor drum 48*a* whilst applying a high positive voltage thereto so that the toner image is attracted to the recording paper by electrostatic attraction.

Cleaning unit 48*e* scrapes the toner that has not been transferred and remains on the photoreceptor drum 48*a* surface, by a cleaning blade and collects the removed toner into a collecting portion. Here, the cleaning blade is configured of a leading type rectangular resin or metal sheet which is arranged so that its scraping edge is directed counter to the rotational direction of photoreceptor drum 48*a* or as if the blade bit into the photoreceptor drum 48*a* surface as it moved, whereby the developer is scraped off.

Referring to sheet conveying system 50, it comprises a feed portion 33 for feeding a sheet P into electrophotographic processing portion 48 for performing the above-described image forming, particularly, the transfer station where transfer unit 48*d* is disposed, paper feed cassettes 51, 52 and 53 for delivering sheet P into the feed portion 33 and a manual paper feeder 54 for supplying paper of necessary sizes as appropriate, a fixing unit 49 for fixing the toner image formed on sheet P after transfer, and a paper recirculating path 55 for re-feeding sheet P so that another image can be formed once again on the rear side of the sheet P after fixing of an image.

Arranged on the downstream side of fixing unit 49 is a post-processing apparatus which receives recording paper P with images recorded thereon and implements the necessary processes on the recording paper P.

The paper with images formed thereon is conveyed from fixing unit 49 to the top of a paper output tray portion 34 (trays 341 or 342 arranged at the top and bottom for separating paper) by way of a paper discharge drive roller 57.

Next, the developing unit of the present invention will be described in detail.

Figure 6:
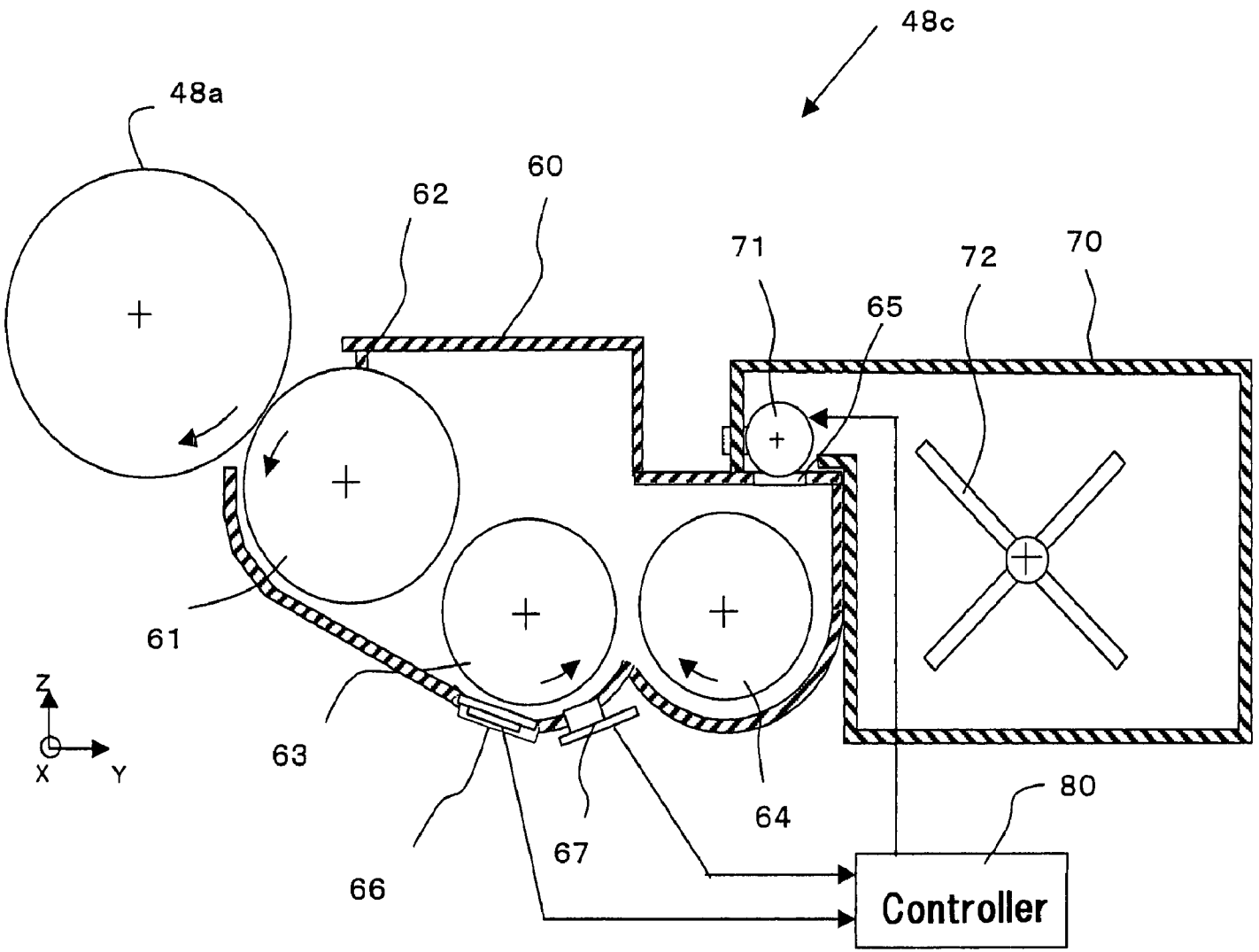
FIG. 6 is a schematic view showing a developing device according to the present invention.

FIG. 6 is a schematic view showing developing unit 48*c*. This developing unit 48*c* is composed of a developing hopper 60 for holding a dual-component developer made up of a toner and a carrier, a toner cartridge 70 for holding toner to be supplied to the developing hopper 60 and a controller 80 for making toner density control. Developing hopper 60 is constructed of a developing roller 61 for supplying toner to photoreceptor drum 48*a* and adhering the toner to the electrostatic latent image, a doctor blade 62 for making uniform the amount of the developer to be given to the photoreceptor drum 48*a* surface, a pair of agitating rollers 63 and 64 for agitating the developer in developing hopper 60, a supply section 65 through which toner is supplied from toner cartridge 70, a piezoelectric oscillator 66 for detecting the fluidity of the developer and a toner density sensor 67 for detecting the toner density by measuring magnetic permeability. Toner cartridge 70 is constructed of a supply roller 71 for supplying toner to developing hopper 60 and agitating vanes 72 for agitating and forwarding the toner to supply roller 71. Controller 80, based on the developer's fluidity detection data detected by piezoelectric oscillator 66, modifies the output data on toner density detected by toner density sensor 67 to a correct value, and controls supply roller 71 to perform toner supply based on that corrected value.

Piezoelectric oscillator 66 and toner density sensor 67 are disposed at the bottom of developing hopper 60 and close to agitating roller 63 and detect the fluidity and toner density of the developer passing through the clearance between agitating roller 63 and the bottom of developing hopper 60.

Next, the outline of the image forming process using this developing unit 48*c* will be described.

In laser writing unit 46 and electrophotographic processing portion 48, the image data read out from the image memory is supplied to laser writing unit 46, which scans the laser beam in accordance with the image data to reproduce an electrostatic latent image on the photoreceptor drum 48*a* surface. This latent image is visualized with toner to form a toner image, which in turn is electrostatically transferred to, and then fixed to, the surface of the paper that is conveyed from one of the paper feeders of multiple paper feed units.

More specifically, a voltage is applied from charger 48*b* to the surface of the electrostatic charge bearer (photoreceptor drum 48*a*) so that the surface is charged with negative polarity. Then, the charged surface is exposed to a light image by scanning the laser beam so as to form a digital latent image. Toner is supplied to photoreceptor drum 48*a* from developing unit 48*c* that includes doctor blade 62 and toner support (developing roller) 61 incorporating magnets so as to perform reversal development of the latent image. The conductive substrate of photoreceptor drum 48*a* is grounded while a d.c. bias is supplied to developing roller 61 from a bias potential source. As the paper is conveyed to the transfer station, the rear side (the side opposite to the photoreceptor drum side) of the paper is charged by transfer charger 48*d* that is supplied from the voltage application source, so that the developed image (toner image) on the photoreceptor drum surface is transferred to the paper by the transfer charger. The paper separated from photoreceptor drum 48*a* is introduced into fixing unit 49 where the toner image is fixed to the paper by heat and pressing rollers.

The toner remaining on photoreceptor drum 48*a* after transfer is cleaned by the elastic blade and collected into the collecting box. The photoreceptor drum 48*a* having been cleaned by cleaning unit 48*e* is set ready for a next image forming process where the same cycle starting from the charging step by the charger is repeated.

As already stated in the background art, the amount of charge on the developer increases or decreases due to humidity, how the developer has been agitated or how the developer has been left unused. As a result the volume density of the developer varies. This change in volume density affects the output from the toner density sensor that detects the toner density by measuring the magnetic permeability, hence correct detection cannot be obtained. It is therefore necessary to compensate for this variation in order to keep the toner density constant. To deal with this, in the present invention the developer's fluidity due to change of the volume density is noticed. That is, the measurement by the toner density sensor is corrected based on the detected value of the developer's fluidity, so as to control the toner density to be uniform.

The embodiment shown in FIG. 6 uses a unimorph oscillator as a fluidity detector and the circuit diagram is shown in this drawing. The "unimorph" is a piezoelectric transducer made of a piezoelectric plate bonded to one surface of a metal plate. Here, in this embodiment a unimorph oscillator is used, but bimorph oscillator may also be used. The "bimorph" is a piezoelectric transducer made of a pair of piezoelectric thin plate and a metal plate held and bonded therebetween.

Figure 7:
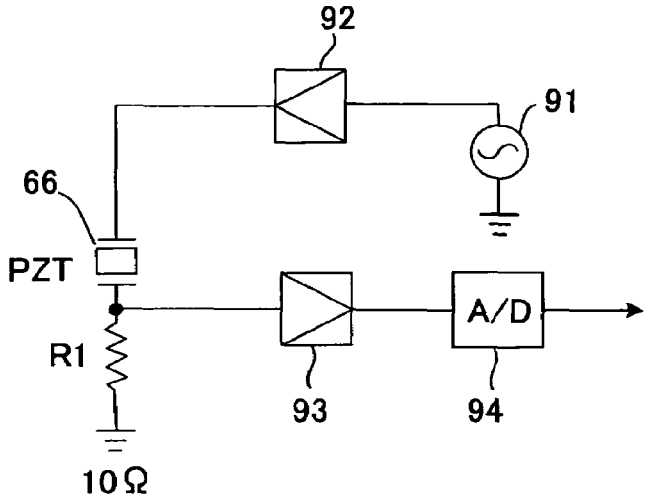
FIG. 7 is a circuit diagram showing a piezoelectric oscillator as a fluidity detection sensor.

As shown in FIG. 7, an a.c. voltage output from an a.c. power source 91 is amplified by an amplifier 92 and applied to one electrode of an unimorph oscillator 66. The other electrode is grounded via a resistor R1. The current value extracted from the other electrode is amplified by an amplifier 93 and converted by an A/D converter 94. This digital value is defined as the detected fluidity value.

The direction of oscillation of this piezoelectric oscillator 66 is parallel to its contact surface with the toner. In other words, it generates transverse waves (thickness shear vibrations). Accordingly, when piezoelectric oscillator 66 is oscillated by applying an a.c. voltage, the electric characteristics such as impedance, admittance and the like vary depending on the viscosity of the developer that is in contact with piezoelectric oscillator 66. This nature is used to detect the developer's fluidity (the piezoelectric oscillator as this fluidity detector should be referred to Japanese Patent Application Laid-open Hei 6 No. 167437).

Based on the detected value from the piezoelectric oscillator, fluidity can be determined (1) based on the variation of the absolute value of the impedance or admittance, (2) based on the variation of the resonance frequency, or (3) based on degree of acuteness Q at resonance.

Fluidity can be obtained based on any of the above methods; in any case, fluidity is determined by measuring the deviation of the detected value from the reference value, and the toner density is calibrated. In the present embodiment, fluidity is determined based on the variation in the degree of acuteness Q of the admittance. Use of the other methods needs more complicated circuitry as needing two oscillation circuits as indicated in the prior art disclosure in order to secure detection accuracy because the variation of the resonance frequency is too small or the resonance frequency will shift due to temperature change and other causes. Detection based on degree of acuteness can be made with a relatively simple circuit.

To begin with, the degree of acuteness Q is defined as:

$$Q=Fr/(F2-F1) \quad (1)$$

where Fr is the resonance frequency, F1 and F2 are the frequencies at which the admittance (electric current) becomes as low as $1/\sqrt{2}$ of the admittance at resonance.

Figure 8:
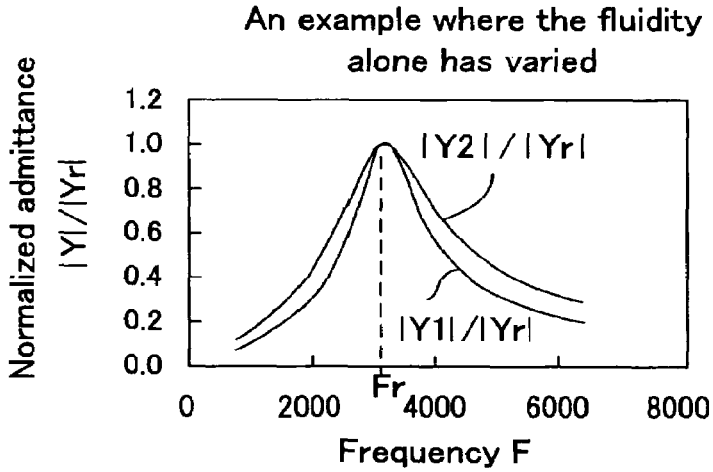
FIG. 8 is a graph showing the relationships between the frequency and the normalized admittance when the fluidity alone has varied.

FIG. 8 shows the normalized admittances (|Y|/|Yr|) based on the admittances Y obtained by unimorph piezoelectric oscillator 66 when toner density is unvaried with fluidity alone varied. When the admittances for the first fluidity and the second fluidity are represented by Y1 and Y2, respectively, they both form normal distributions having the maximum at a resonance frequency Fr. In this case, no toner density change occurs, hence the resonance frequencies representing the first fluidity and the second fluidity are common at Fr so that it is not necessary to make corrections of toner density.

Figure 9:
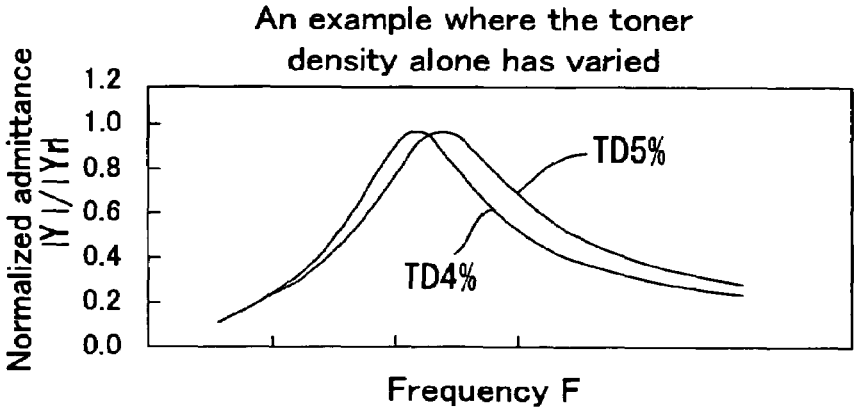
FIG. 9 is a graph showing the relationships between the frequency and the normalized admittance when the toner density alone has varied.

FIG. 9 shows the normalized admittances obtained by unimorph piezoelectric oscillator 66 when fluidity is unvaried with toner density alone varied. This graph shows the case where toner density changes from 5% to 4%. Accordingly, the resonance frequency at each density differs from that at the other density, so does the degree of acuteness Q. FIG. 10 and FIG. 11 show specific examples for correcting the output value from the toner density sensor, based on change of the degree of acuteness Q.

For the detected value of toner density sensor 67 being 5% and 4%, resonance frequency Fr, frequencies F1 and F2 at which the admittance (electric current) becomes equal to $1/\sqrt{2}$ of the admittance at resonance are determined (see FIG. 10), based on the graph of FIG. 9, which is obtained by detection from unimorph piezoelectric oscillator 66. Based on the aforementioned Eq. (1), the value of the degree of acuteness Q at a toner density of 5% as the reference is determined and represented as (a), and the value of the degree of acuteness Q at a toner density of 4% after variation is determined and represented as (b). The correction coefficient (c) for the detected value by toner density sensor 67 is determined as $$(c)=(b)/(a) \quad (2).$$

When the detected value by toner density sensor 67 has varied, correction can be made as follows by using the aforementioned correction coefficient (c). That is, when the toner density after correction is represented as (d), (d) can be given as:

$$(d)=(\text{the toner density after variation})/(c)+0.3\% \quad (3).$$

Here, 0.3% is a value that is set so that the modified value (d) will take a correct value, and depends on the developer characteristics and the characteristics of piezoelectric oscillator 66 and toner density sensor 67.

As shown in FIG. 10, as the value is substituted into Eq. (3), the corrected toner density (d) is obtained to be 4.0%, which agrees with the detected value. That is, this variation is not the one that is caused by change of the volume density but is the case where the toner density has actually changed, and in the above way it is possible to obtain the correct value when correction is made based on Eq. (3).

Other than the above correcting method, it is possible to determine the corrected toner density in a more simple manner.

Determination of the degree of acuteness Q needs complicated calculation because it is necessary to determine frequencies F1 and F2 frequencies at which the admittance (electric current) becomes equal to $1/\sqrt{2}$ of the admittance at resonance. To avoid this complexity, correction may made based on Fr/F0.5 which approximates the degree of acuteness Q, where Fr is the resonance frequency and F0.5 is the frequency at which the admittance becomes equal to ½ of the admittance at resonance, obtained from the graph of the normalized admittance. As shown in FIG. 11, suppose that FR/F0.5 before variation in toner density is (e) and FR/F0.5 after variation in toner density is (f), the corrected toner density can be given as (h):

$$(h)=(\text{the toner density after variation})/((1-(g)\times 2+1)+0.3\% \quad (4),$$

where the correction coefficient (g)=(f)/(e).

The corrected toner density calculated by this formula (4) results in 4.1, thus a value close to the measurement of the toner density sensor can be obtained.

FIG. 12 is a graph showing the normalized admittance distributions obtained by the piezoelectric oscillator when the detected value by toner density sensor 67 has varied from 5% to 4% due to change of fluidity and volume density.

In this case, only the detected toner density changes due to change in fluidity and volume density, and the actual toner density has not changed. In this case, as shown in FIG. 13, the corrected value is calculated based on the degree of acuteness Q determined from FIG. 12. The corrected toner density (d) is given to be 5.0 by Eq. (3), which is approximately equal to the measurement before variation.

In FIG. 14, the corrected value determined by the simplified correction formula (h) based on Eq. (4) is shown. Also in this case, the corrected toner density is equal to 5.0, which is equivalent to the corrected value determined based on the degree of acuteness Q.

Figures 15, 16:
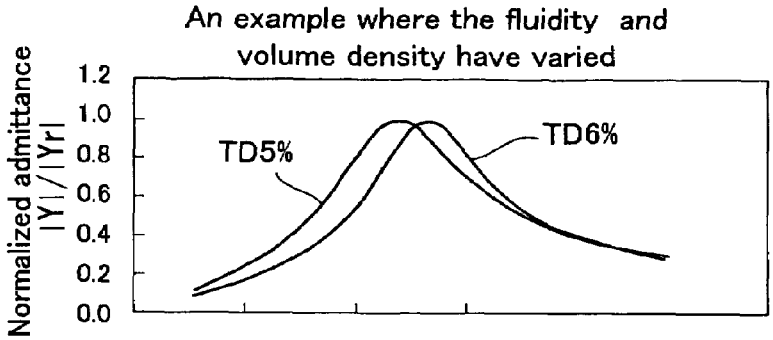
FIG. 15 is an another graph showing the relationships between the frequency and the normalized admittance when the fluidity and volume density have varied.
FIG. 16 is a chart for explaining correction to the output value of a toner density sensor based on the above degree of acuteness Q in the above case.

FIG. 15 is a graph showing the normalized admittance distributions obtained by the piezoelectric oscillator when the detected value by toner density sensor 67 has varied from 5% to 6% due to change of fluidity and volume density.

Also in this case, only the sensor-detected toner density changes due to change in fluidity and volume density, and the actual toner density has not varied. FIG. 16 shows the way of calculating the corrected value based on the degree of acuteness Q determined from FIG. 15. The corrected toner density (d) is given to be 5.0 by Eq. (3), which agrees with the measured value before variation. Though the sensor-detected toner density merely varies to due change in fluidity and volume density, the actual toner density must not have changed, and this corrected value (d) endorses this.

In FIG. 17, the corrected value determined based the simplified correction formula (h) shown by Eq. (4) is shown. Also in this case, the corrected toner density is equal to 5.0, which is equivalent to the corrected value determined based on the degree of acuteness Q.

As described heretofore, it is obvious that fair correction can be made based on the toner density correction using Eqs. (3) and (4).

Though in the present embodiment fluidity is detected using a piezoelectric oscillator, the method of detection is not limited to this. In the following description, the fluidity of the developer is directly detected by determining the variation in the load torque on the agitating roller based on the variation of the drive current of the agitating roller motor. FIG. 18 shows a circuit diagram for detection of load torque.

This detecting device is made up of a pulse motor 101 for rotating agitating rollers 63 and 64 and a motor driver 102 for driving the pulse motor, and detects the electric current flowing through the motor driver 102. For this purpose, a resistor R2 is interposed between motor driver 102 and the ground, and the current is detected by way of a resistor R3 which is connected to the end of a resistor R2 on the motor driver 102 side. In this configuration, a capacitor C1 with its one end grounded is connected to the detection side of R3.

It is possible to determine the drive load torque required for rotating the agitating roller from this current value. This can be easily done when the relationship between the current and the drive torque has been measured beforehand. Further, it is possible to determine the fluidity from the drive load torque when the relationship between the drive load torque and the fluidity has been determined, as shown in FIG. 19.

Figures 20, 21, 22:
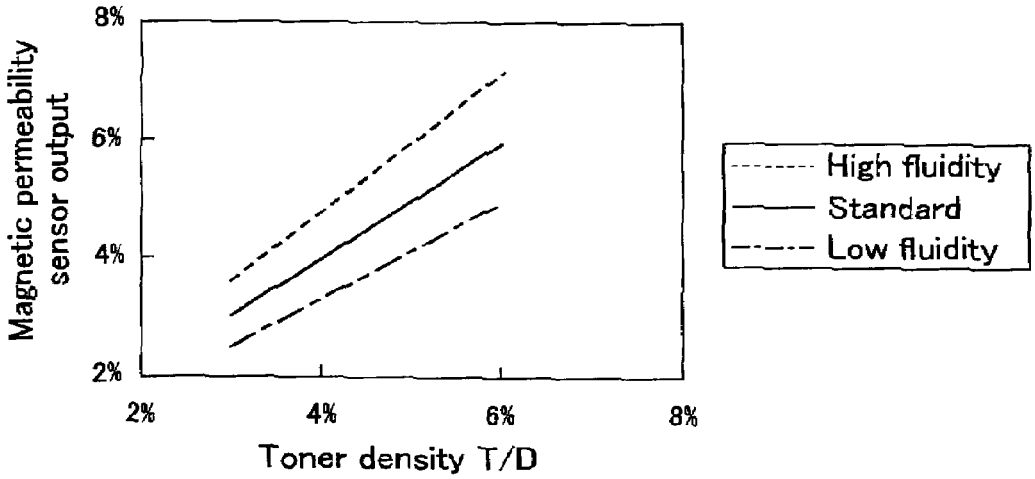
FIG. 20 is a chart for explaining correction to the output value of a toner density sensor based on drive load torque.
FIG. 21 is a graph showing the relationship between toner density and sensor output for different fluidity conditions.
FIG. 22 is a chart for explaining correction to the output value of a toner density sensor based on the output value from a toner density sensor.

FIG. 20 shows toner density correction of the output value from the toner density sensor based on the drive load torque.

When it is assumed that the detected value of the toner density is represented by (a) and the drive load torque is represented by (b), the corrected toner density can be given as (a)×(b).

The drive load torque can be determined using methods other than by measuring the current through the motor for rotating the agitating roller. For example, the variation in the rotational rate of the agitating roller may be detected using an optical sensor or the like so as to determine the load torque based on that variation.

It is also possible to detect the variation in load torque based on the variation in the output from the toner density sensor which occurs as the developer passes by the agitating roller. In this case, it is possible to make detection of fluidity and correction of the toner density as a whole by the toner density sensor.

As shown in FIG. 21, patterns of variation in toner density are previously measured. This includes three patterns (high, standard and low fluidity) for the relationship between the output value (detected value) of the toner density sensor and the actual toner density (corrected value). FIG. 22 shows the data measured for individual items. When the correction value is determined, the pattern which meets the variation of the sensor output value is selected first then the corrected value is determined based on that pattern.

What is claimed is:

1. A developing device for developing an electrostatic latent image formed on a photoreceptor with a dual-component developer, made up of a toner and a carrier while the developer being agitated by an agitating member, comprising:

a toner supply section for supplying the toner;

a toner density detector for detecting the toner density of the developer based on magnetic permeability; and a fluidity detector for detecting the fluidity of the developer, characterized in that the output from the toner density detector is corrected based on the detected data from the fluidity detector, and toner supply from the toner supply section is performed based on the corrected output so as to keep the toner density constant.

2. The developing device according to claim 1, wherein the fluidity detector is a piezoelectric oscillator.

3. The developing device according to claim 2, wherein the fluidity detector detects fluidity based on a degree of acuteness of a resonant oscillation of the piezoelectric oscillator.

4. The developing device according to claim 2, wherein the piezoelectric oscillator is a unimorph oscillator or bimorph oscillator.

5. The developing device according to claim 1, wherein the fluidity detector detects fluidity based on the variation of a load torque on the agitating member.

6. The developing device according to claim 5, wherein the fluidity detector detects the variation of the load torque based on change in the rotational rate of the agitating member.

7. The developing device according to claim 5, wherein the fluidity detector detects the variation of the load torque based on change in the current through a motor for driving the agitating member.

8. The developing device according to claim 5, wherein the fluidity detector detects the variation of the load torque based on change in the output from the toner density sensor while the developer passes through the agitating member.

* * * * *